US005546684A

United States Patent [19]

Jensen

[11] Patent Number: 5,546,684

[45] Date of Patent: Aug. 20, 1996

[54] METHOD AND AN APPARATUS FOR FEEDING A LAUNDRY ARTICLE TO A LAUNDRY PROCESSING APPARATUS

[75] Inventor: Jørn M. Jensen, Bern, Switzerland

[73] Assignee: Ejnar Jensen & Son A/S, Rønne, Denmark

[21] Appl. No.: 380,422

[22] Filed: Jan. 30, 1995

[30] Foreign Application Priority Data

Feb. 8, 1994 [DK] Denmark ..... 0163/94

[51] Int. Cl.[6] ..... D06F 67/04

[52] U.S. Cl. ..... 38/143

[58] Field of Search ..... 38/143; 198/345.1, 198/376, 417; 271/226, 233, 261

[56] References Cited

U.S. PATENT DOCUMENTS

| | | | |
|---|---|---|---|
| 2,624,138 | 1/1953 | Taylor | 38/143 |
| 5,172,907 | 12/1992 | Kalisiak | 271/201 X |
| 5,430,915 | 7/1995 | Ueda et al. | 38/143 X |

FOREIGN PATENT DOCUMENTS

| | | |
|---|---|---|
| 266820 | 5/1988 | European Pat. Off. . |
| 419382 | 3/1991 | European Pat. Off. . |
| 424290 | 4/1991 | European Pat. Off. . |

*Primary Examiner*—Ismael Izaguirre
*Attorney, Agent, or Firm*—Finnegan, Henderson, Farabow, Garrett & Dunner

[57] ABSTRACT

A method and an apparatus for feeding substantially rectangular laundry articles to a laundry processing apparatus, such as an ironing roller, comprising alignment of the rear edge on the laundry article to a predetermined angle with respect to the direction of feed on a conveyor face, on which the laundry article is conveyed with the rear edge stretched, the position of the rear edge with respect to the conveyor face being detected at a plurality of locations on the rear edge transversely to the direction of feed, following which the rear edge is braked locally with respect to the conveyor face as it passes a straight line having the predetermined angle with respect to the direction of feed. This ensures that the alignment of the laundry article in the feeder can take place during the continued feeding of the laundry article on the conveyor face, thereby reducing the throughput time for a laundry article in the apparatus.

11 Claims, 5 Drawing Sheets

METHOD AND AN APPARATUS FOR FEEDING A LAUNDRY ARTICLE TO A LAUNDRY PROCESSING APPARATUS

BACKGROUND OF THE INVENTION

The present invention concerns a method of feeding substantially rectangular laundry articles to a laundry processing apparatus, such as an ironing roller, comprising aligning the rear edge of the laundry article to a predetermined angle with respect to the travelling direction on a conveyor plate, following which the laundry article is conveyed with the rear edge stretched, as well as an apparatus for performing the method.

These apparatuses are primarily used in big laundries in which they are used for smoothing and spreading large laundry articles, such as sheets, table-cloths, slips for eiderdowns, etc. for subsequent insertion of the laundry article into e.g. an ironing roller, it being important that these feeding devices spread and smoothen the laundry articles effectively so that undesired creases will not occur after the ironing roller. Most frequently, the laundry articles are inserted into the apparatus in that a laundry article is taken from a pile of laundry articles in a wrinkled state and optionally wet or damp, following which the laundry article is inserted into the machine, which subsequently processes the laundry article so that it can be transferred to e.g. an ironing roller in a spread and smoothened state.

Even though the laundry article is thus transferred to an optional ironing roller in a spread and smoothened state, unintentional creases in the laundry article may occur however after the ironing roller, if the laundry article is inserted askew into the ironing roller. These unintentional creases are produced in that, in this case, the ironing roller first pulls a corner of the laundry article forwardly, thereby forming wrinkles on the laundry article. It is therefore important e.g. in connection with such ironing rollers that the laundry article is oriented such that the entire one edge of the laundry article is moved into the ironing roller approximately in parallel with the axis of rotation of the ironing roller.

Therefore, feeders are frequently provided with a device capable of orienting the laundry article such that when inserted into a subsequent optional ironing roller the laundry article has the desired orientation.

Numerous proposals for the construction of devices capable of performing the above-mentioned processes are known today. Thus, EP patent application 266 820 discloses a feeder comprising a roller capable of rotating about its own axis, the laundry article being so positioned across said roller as to extend down on both sides of the roller. The laundry article will then frequently be disposed askew on the roller, which is therefore adapted so as to be twistable about its own longitudinal axis such that the laundry article may be aligned with respect to the roller. This alignment takes place by positioning the laundry article with respect to a plurality of optional sensors arranged in a horizontal plane, so that these can detect an edge on the part of the laundry article which hangs down on one side of the roller. The roller can then be rotated and twisted in sequence, so that the edge of the laundry article precisely covers the row of optical sensors, said laundry article having thereby been aligned with respect to the feed direction of the roller.

Further, EP patent application 424 290 discloses a feeder having a short and wide conveyor belt across which the laundry article is hung so as to hang down on each side of the conveyor belt. This feeder too has sensors detecting the position of the rear edge of the laundry article on the conveyor belt with a view to aligning the laundry article with respect to this conveyor belt. In this device, the alignment takes place by retaining the part of the laundry article hanging down on one side, while causing the laundry article to be moved with respect to the conveyor belt. This is effected by pressing an elongate rod toward the laundry article between the location where the laundry article is retained and the conveyor belt, whereby the laundry article is displaced on the conveyor belt, thereby making it possible to align the laundry article with respect to the conveyor belt.

In both of the above-mentioned devices the detection of the position of the laundry article takes place in the manner that the laundry article is first moved to and fro across the roller or the conveyor belt, until one of the outermost photocells is precisely covered or exposed with respect to the laundry article. Then there is a separate activity to align the laundry article, by twisting the roller or displace the laundry article across the conveyor belt, which stands still in this position. This process goes on until the rear edge of the laundry article is aligned with respect to the sensors, following which the laundry article is properly positioned on the roller as well as the conveyor belt. The roller or the conveyor belt is then started to advance the laundry article, which is then transferred to the subsequent laundry processing apparatus.

Even though these devices can thus align the laundry article fully automatically, they are vitiated by a serious drawback, because the above-mentioned processes cannot be performed with continuous feeding of the laundry article. In certain cases, it is even necessary for the laundry article to be conveyed rearwardly with respect to the direction of feed because of the necessity of initially positioning the rear edge of the laundry article opposite one of the sensors. In particular the feeder of EP patent application 424 290 requires that the conveyor belt stands still during the laundry article aligning process.

The object of the invention is to provide a method and an apparatus which make it possible to perform detection of the position of the laundry article rear edge as well as braking or alignment of the laundry article during the continued feeding of the laundry article.

SUMMARY OF THE INVENTION

This object is achieved by providing a method of feeding substantially rectangular laundry articles to a laundry processing apparatus, such as an ironing roller, comprising aligning the rear edge on the laundry article to a predetermined angle with respect to the direction of feed on a conveyor face on which the laundry article is conveyed with the rear edge stretched, and detecting the position of the rear edge with respect to the conveyor face at a plurality of locations on the rear edge transversely to the direction of feed, characterized by then braking the rear edge locally with respect to the conveyor face as it passes a straight line which has the predetermined angle with respect to the direction of feed.

Since the alignment here takes place by braking the rear edge on the laundry article locally with respect to the conveyor face as it passes a straight line having the predetermined angle with respect to the direction of feed, it is possible to position the sensors in such a manner that exact positioning of the laundry article with respect to the sensors prior to the alignment is not required.

Also provided is an apparatus for feeding substantially rectangular laundry articles to a laundry processing apparatus, such as an ironing roller, comprising a conveyor face on which the laundry articles are fed so that the rear edge of the laundry article, seen in the direction of feed, is stretched in any angle with respect to the direction of feed, and means for aligning the rear edge to a predetermined angle with respect to the direction of feed, said means comprising a detecting device which is adapted to detect the position of the rear edge at a plurality of locations along it transversely to the direction of feed, characterized in that the aligning means additionally comprise a braking device adapted to brake the laundry article along a straight line with the predetermined angle with respect to the direction of feed, said detecting device and said braking device being adapted to cooperate so that the braking device is activated to brake the rear edge on the laundry article as it passes the straight line.

The apparatus of the invention has the additional advantage that it provides a faster throughput time for the laundry article because of the continuous alignment of the laundry article.

BRIEF DESCRIPTION OF THE DRAWINGS

An expedient embodiment of the invention will be described more fully below with reference to the drawing, in which.

DETAILED DESCRIPTION OF THE INVENTION

Figure 1:
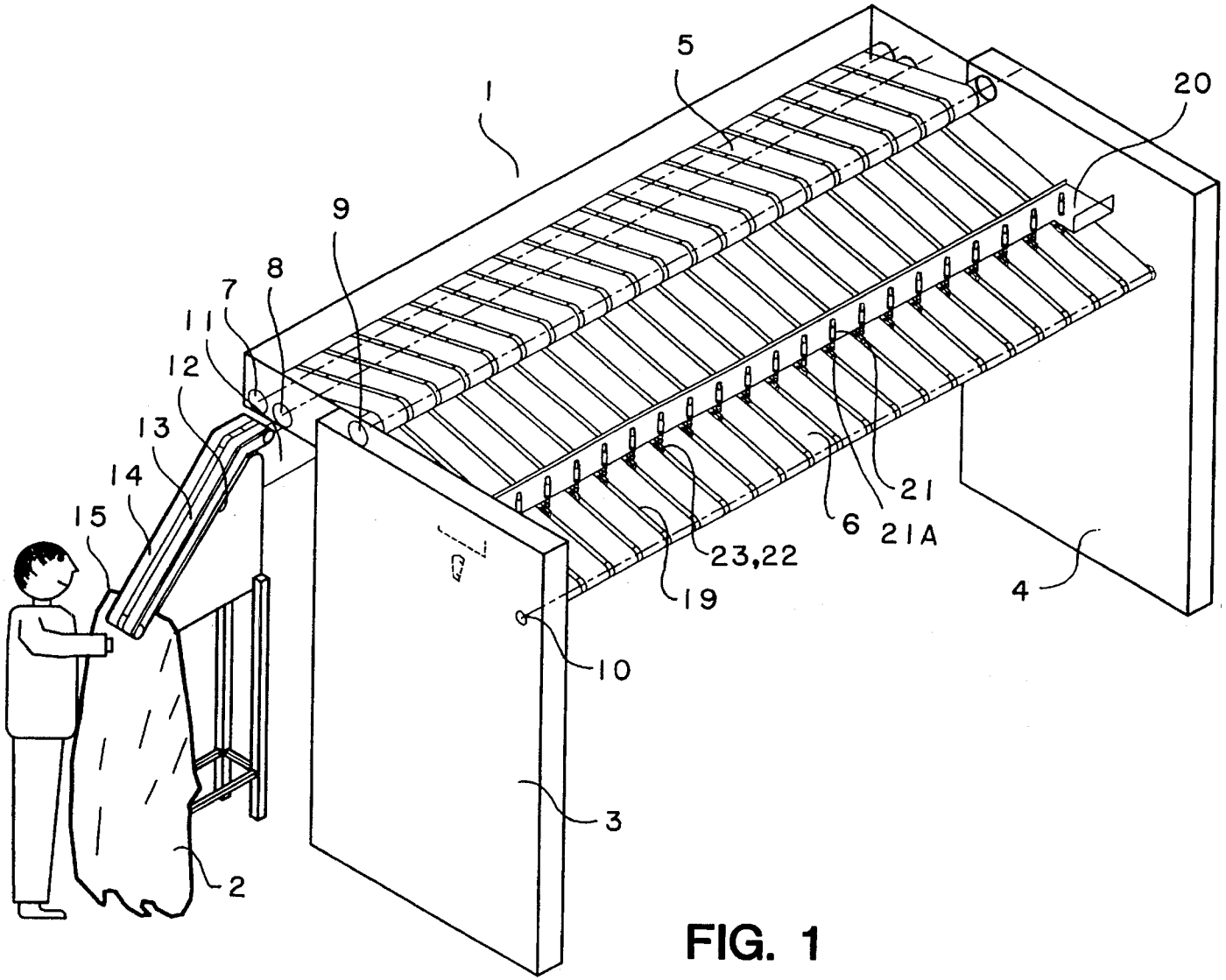
FIG. 1 is a perspective view of an apparatus according to the invention and of an operator.

FIG. 1 is a schematic and perspective view of an embodiment of a feeder according to the invention. The machine is provided with two end gables 3 and 4 between which two conveyor belts 5 and 6 are located. The conveyor belt 6 extends partly below the conveyor belt 5, and the conveyor belt 6 is tightened by the rollers 8 and 10. A bar 11, whose function will be described more fully below, is located below and straight in front of the rollers 7 and 8.

The feeder of the invention may expediently comprise a plurality of parallel conveyor belts forming the conveyor face, said conveyor belts having a length that corresponds to the length of the laundry articles, which ensures that the laundry article lies stably and securely on the conveyor face in its entire extent, enabling certain detection of the position of the laundry article with respect to the conveyor face, while ensuring that the laundry article cannot flap and form wrinkles during the conveying process and the aligning process.

An operator-operated insertion device is positioned at one end of the bar 11, as shown; the insertion device here consists of an underlying runway 12, above which two parallel conveyor belts 13 and 14 are positioned so as to be in firm engagement with the runway 12. The conveyor belt 6 is formed by a row of ribbons which are arranged with mutual spaces 19, and a beam 20 is arranged across the conveyor belt 6, provided with a plurality of pneumatic pistons 21 having a clamping face 21A opposite each of the spaces 19. Further, in the spaces, stops 22 are arranged opposite the clamping face of each of the pneumatic pistons 21, and an optical sensor 23 is arranged straight in front of the stop 22, seen in the travelling direction of the conveyor belt.

The position of the rear edge with respect to the direction of feed may be detected by many means, but it is preferred according to the invention that the detection means comprise a row of the sensors. This provides a very reliable and inexpensive structure.

When the braking device comprises a straight row of clamp means such as pistons 21 and stops 22 provided in the spaces between the conveyor belts, the braking is particularly reliable, and contributes to stretching the laundry article in the continued forward travel of the conveyor belt, thereby additionally obviating inexpedient folds on the laundry article.

A particularly simple and inexpensive structure is to mount the sensors in pairs with the clamp means. Since they are mounted close to each other, it is possible to avoid sophisticated control of the clamp means, as the individual sensor can control the associated clamp means directly.

When stops are arranged at the spaced between the conveyor belt and lifted with respect to said belt and displaceable clamping faces are provided opposite the stops, then, in a simple structure, the laundry article is retained securely with respect to the conveyor belt, while ensuring that the rear edge of the laundry article does not wrinkle because of the continued movement of the conveyor belt, since this rear edge is lifted away from the conveyor belt in this manner.

The operator starts the process by inserting the laundry article 2 between the conveyor belts 13 and 14 and the underlying runway 12, so that one corner 15 of the laundry article is positioned laterally of the conveyor belts 13 and 14, and so that a small portion of the edge of the laundry article 2 is stretched between the conveyor belts 13 and 14 and the underlying runway 12. The conveyor belts 13 and 14 are then activated to pull the laundry article 2 up to the bar 11.

The function and mode of operation of the feeder 1 will be described now as a series of individual processes according to the method of the invention.

Figure 2A:
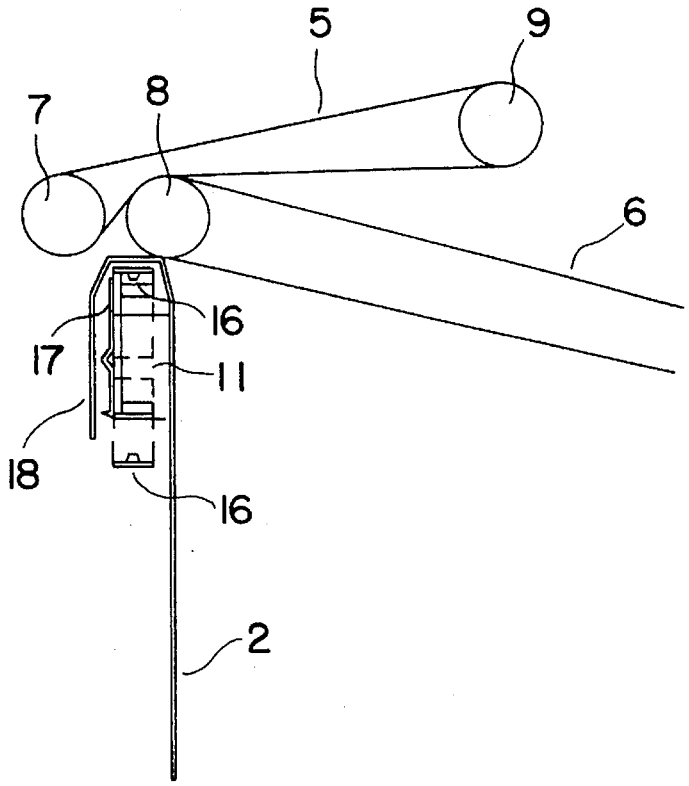
FIG. 2*a* is a schematic sectional view of a detail in the apparatus of FIG. 1.
Figure 2B:
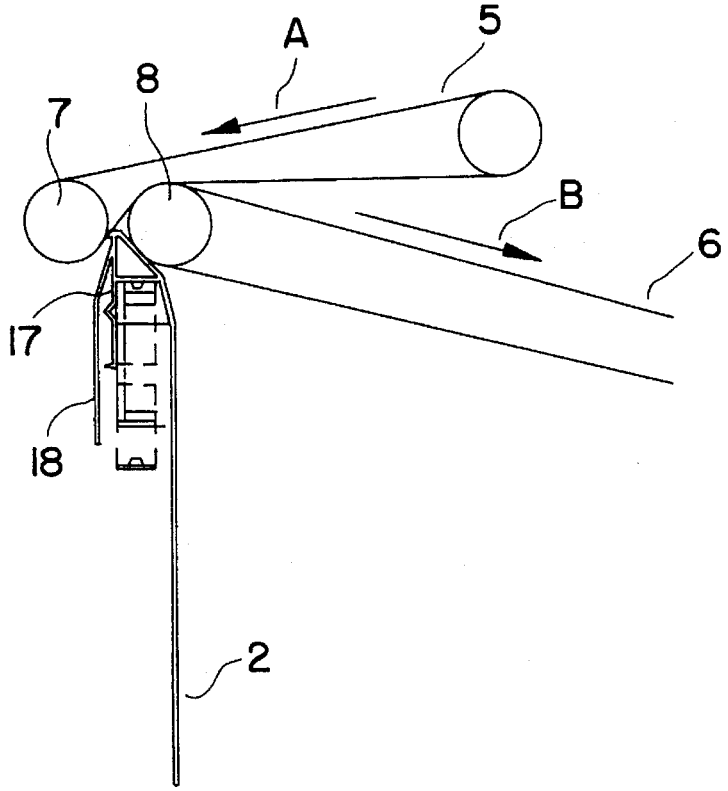
FIG. 2*b* is a view of the detail of FIG. 2*a* in another process position.

FIG. 2*a* thus shows that the laundry article 2 is pulled across the bar 11, which is positioned below the rollers 7 and 8 that tighten the conveyor belts 5 and 6. This is done through the provision of a narrow conveyor belt 16 which extends the entire length of the bar, and which can thus pull the entire laundry article 2 into position on the bar 11. When the laundry article 2 is introduced at the end of the bar with one of the corners 15 of the laundry article 2, as stated above, the laundry article 2 hangs across the bar 11 with a minor flap 18 bent across the bar 11. The bar 11 additionally comprises a slidable plate element 17 which extends the entire length of the bar 11. As shown in FIG. 2*b*, the slidable plate element 17 is moved by means (not shown) up toward the rollers 7 and 8 of the conveyor belts 5 and 6, the conveyor belt 5 being caused to move in the direction of the arrow A, and the conveyor belt 6 being correspondingly caused to move in the direction of the arrow B. The movements of the conveyor belts 5 and 6 will thus cause the laundry article 2 with the bent flap 18 to be pulled up as the slidable plate element 17 is moved up between the rollers 7 and 8.

Figure 3:
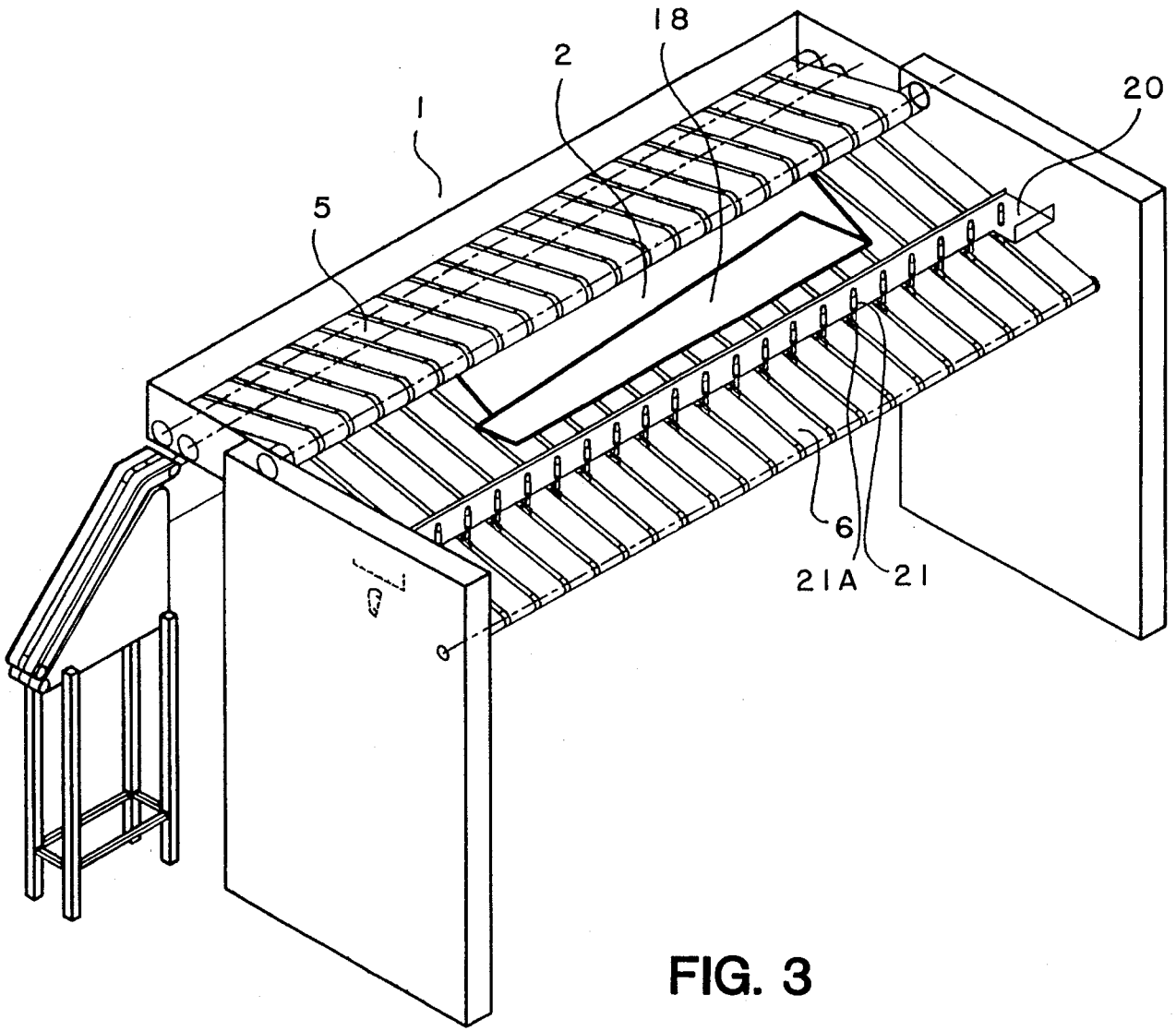
FIG. 3 is a view of the apparatus of FIG. 1 with a laundry article transferred in the machine with a fold.
Figure 4:
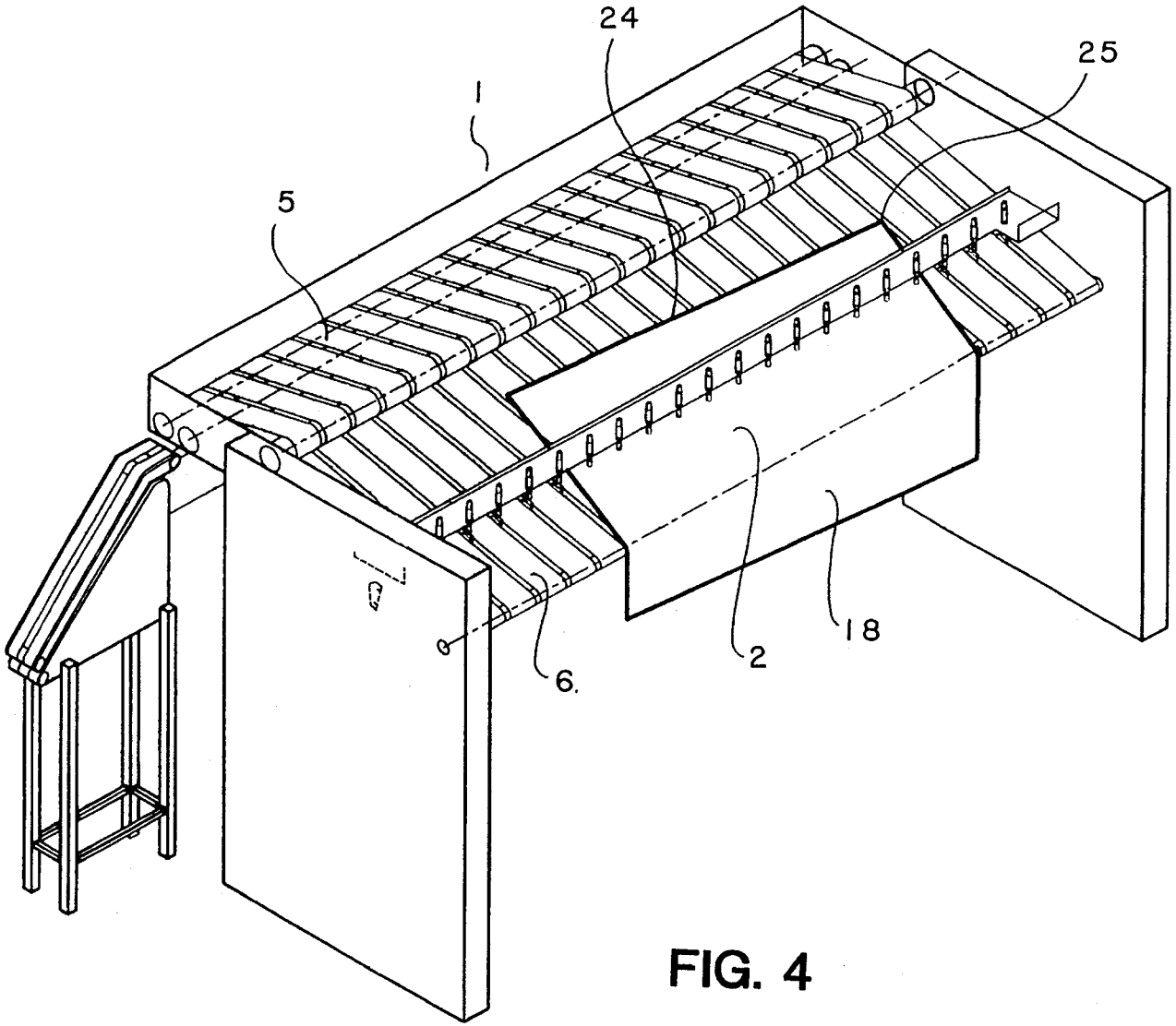
FIG. 4 shows the apparatus of FIG. 3 where the laundry article is smoothened.

The movements of the conveyor belts 5 and 6 will then bring the laundry article 2 with the bent flap 18 into a position in which the laundry article 2 is positioned, as shown in FIG. 3, on top of the conveyor belt 6. Since the laundry article 2 has now been removed from the bar 11, the operator can insert a new laundry article 2 already now and begin the process once more. Final smoothing of the laundry article 2 then takes place, as shown in FIG. 4, in that the continued movement of the conveyor belt 6 in the direction B shown in FIG. 2*b* causes the laundry article 2 to be moved toward the edge of the conveyor belt 6 which is defined by the roller 10, following which the bent flap 18 on the laundry article 2 drops beyond the edge, and the laundry article has hereby been completely straightened and smoothed.

Figure 5:
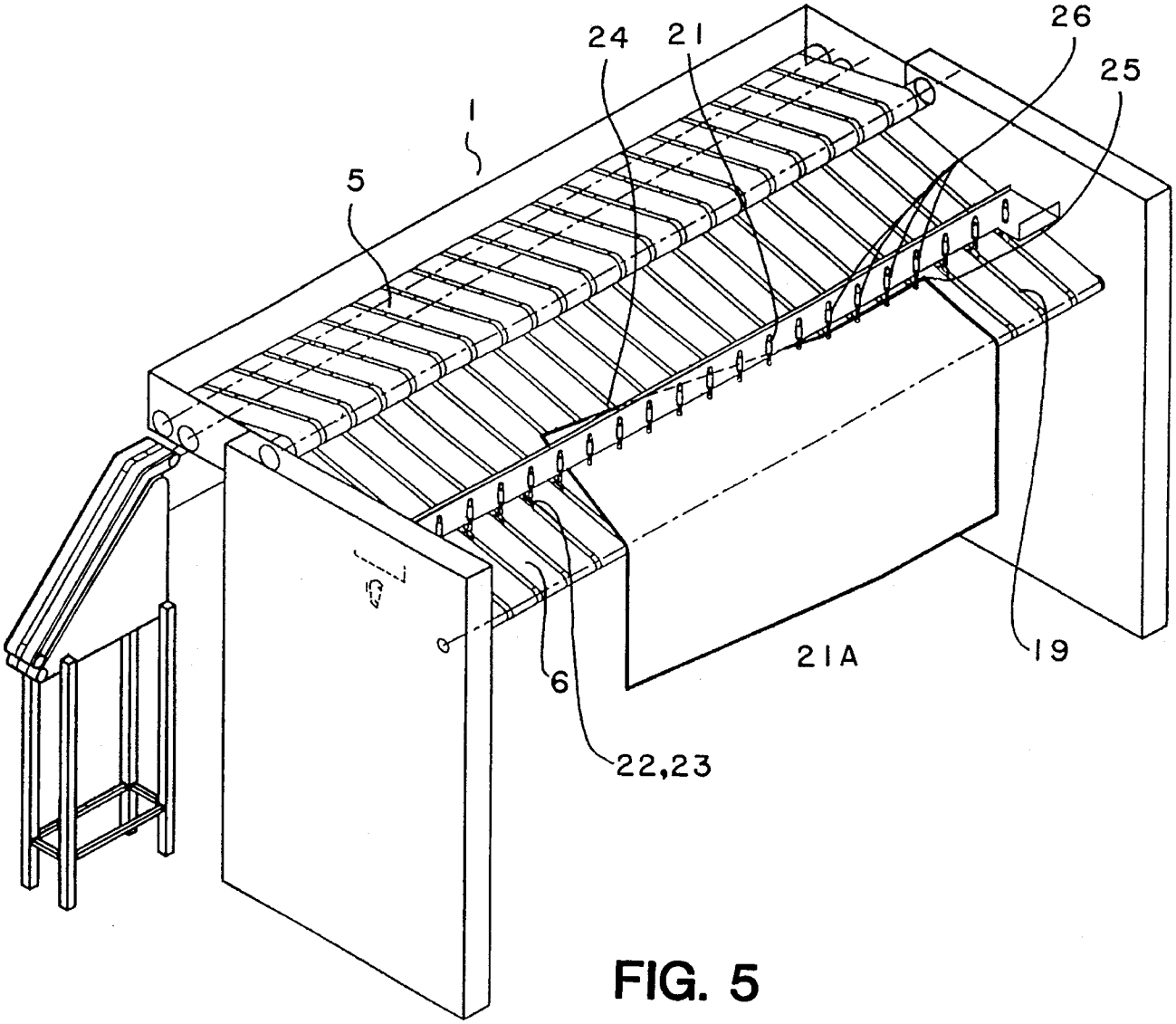
FIG. 5 shows the apparatus of FIG. 3 where the laundry article has been partly braked at its rear edge.

In this situation, the optical sensors 23 detect that the laundry article is present over some of the sensors. In the continued forward travel of the conveyor belt 6, the rear edge 24 of the laundry article is gradually moved until some of the sensors 23 are exposed. Some of the pneumatic pistons 21 are than activated by control means (not shown), so that the rear edge 24 of the laundry article 2 is braked locally as soon as one of the sensors is exposed. FIG. 5 shows how the rear edge 24 of the laundry article 2 is braked locally from one corner 25 of the laundry article toward the other corner 26 of the laundry article at the rear edge 24, in that some pneumatic cylinders 26 of the row of pneumatic cylinders 21 are activated.

The laundry article 2 has hereby been aligned in a simple manner with respect to the travelling direction B of the conveyor belt 6, following which the pneumatic pistons 26 are retracted, and the laundry article 2 may be passed further on in the apparatus.

The shown embodiment of the invention is unique in being a particularly simple and inexpensive structure, while providing a high degree of operational reliability in the apparatus.

However, nothing prevents the invention from being utilized in a large number of alternative embodiments, without the advantages associated with the invention being lost. Thus, the conveyor belts may e.g. be replaced by rollers, roller paths, air cushion paths and the like, and their extent in width as well as in length may be varied as needed.

Further, the row of optical sensors may e.g. be replaced by a video camera, which is adapted so as to be capable of detecting the rear edge of the laundry article 2 and of generating signals to control the braking device. If the conveyor face, which is shown here as a conveyor belt 6, has a well-defined and known speed, it is moreover possible to arrange the optical sensors at a distance in front of the braking devices, which are here formed by pneumatic pistons, said pneumatic pistons 21 being activated with a certain time delay in response to the advancing speed of the conveyor belt 6.

Nor is it absolutely necessary to use more than two optical sensors, since these two optical sensors may be arranged such that a value of the angle of the rear edge 25 of the laundry article 2 with respect to the conveyor belt 6 may be generated in a known manner, in response to which control signals for the pneumatic pistons 21 or another corresponding braking device may be generated.

The pneumatic pistons 21 may moreover be replaced by other actuators, such as electromagnetic actuators. All together, it is possible to use any device which is capable of braking the rear edge 25 of the laundry article 2 locally along a straight line as the rear edge 25 passes this straight line, and which can be activated for this purpose.

It will moverover be obvious to a skilled person to provide sequence controls and drive devices, etc. so that the feeder 1 can automatically perform the above-mentioned functions.

Tests with the feeder 1 have shown that an extremely high productivity can be achieved with a single operator. It is even possible, if desired, that the same apparatus may be operated by several operators, there being provided a separate feeder for each operator.

I claim:

1. A method for aligning a substantially flat laundry article for feeding in an aligned position to a laundry processing apparatus comprising feeding the article along a substantially flat face of a conveyor in a feeding direction with a rear edge of the article stretched flat across the conveyor face and past a straight line extending at a predetermined angle with respect to the direction of feed, detecting the position of the rear edge of the article with respect to the conveyor face at a plurality of locations along its length in a direction transverse to the feeding direction and braking movement of the rear edge of the article in response to its detected position at a plurality of locations locally along said straight line as the rear edge passes said line to align the rear edge of the article with the line, the continued forward movement of the article, while the rear edge is being braked, thereby straightening out and aligning the article for feeding to the laundry processing apparatus.

2. Apparatus for aligning substantially flat laundry articles for feeding in an aligned position to a laundry processing apparatus comprising conveyor means having a substantially flat conveyor face for conveying the articles in a feeding direction with a rear edge of the article stretched flat across the conveyor face and aligning means for aligning the rear edge of the article with a straight line extending at a predetermined angle with respect to the direction of feed, said aligning means comprising detecting means for detecting the position of the rear edge of the article with respect to the conveyor face at a plurality of locations along its length in a direction transverse to the direction of feed, braking means for braking movement of the rear edge of the laundry article at a plurality of locations extending along said straight line and means for activating the braking means in response to the detected position of the rear edge to locally brake the rear edge of the article as the rear edge passes the straight line and align the edge with the line, continued forward movement of the conveyor means, while the rear edge is being braked, straightening out and aligning the article for feeding to the laundry processing apparatus.

3. The apparatus of claim 2, wherein the conveyor means comprises a plurality of parallel conveyor belts arranged side by side and with mutual spaces between them in the feeding direction.

4. The apparatus of claim 2 or 3, wherein the detecting means comprises a row of sensors arranged in a direction transverse to the direction of feed.

5. The apparatus of claim 3, wherein the braking means comprises a row of a plurality of clamps adapted to releasably clamp the rear edge of a laundry article, said row of clamps being located along said straight line and in at least some of the spaces between the conveyor belts.

6. The apparatus of claim 3, wherein the detecting means comprises a row of sensors arranged in a direction transverse to the direction of feed and the braking means comprises a row of a plurality of clamps adapted to releasably clamp the rear edge of a laundry article, said row of clamps being located along said straight line and in at least some of the spaces between the conveyor belts.

7. The apparatus of claim 6, wherein the clamps and the sensors are mounted in pairs close to each other, the optical sensors being positioned in front of the clamps with respect to the direction of feed, each sensor being adapted to activate an associated clamp when the rear edge of the article passes that sensor.

8. The apparatus of claim 6 or 7, wherein each of the clamps comprises a stop positioned in a space between the conveyor belts and slightly above the conveying face of the belts, a slidable clamping face located on a bar opposite each stop that is slidable toward the stop and an actuator activated by a sensor to slide the face toward the stop.

9. The apparatus of claim 8, wherein the actuator is a pneumatic cylinder.

10. The apparatus of claim 8, wherein the actuator is an electromagnetic actuator.

11. The apparatus of claim 2, wherein the predetermined angle is perpendicular to the direction of feed.

* * * * *